US005641922A

United States Patent [19]

Shivanath et al.

[11] Patent Number: 5,641,922

[45] Date of Patent: Jun. 24, 1997

[54] HI-DENSITY SINTERED ALLOY AND SPHEROIDIZATION METHOD FOR PRE-ALLOYED POWDERS

[75] Inventors: Rohith Shivanath; Peter Jones; Danny Thien Duc Thieu, all of Toronto, Canada

[73] Assignee: Stackpole Limited, Mississauga, Canada

[21] Appl. No.: 667,590

[22] Filed: Jun. 24, 1996

Related U.S. Application Data

[62] Division of Ser. No. 496,726, Jun. 29, 1995, Pat. No. 5,552,109.

[51] Int. Cl.[6] ..... C22C 35/00

[52] U.S. Cl. ..... 75/231; 75/243; 75/246

[58] Field of Search ..... 75/231, 243, 246

[56] References Cited

U.S. PATENT DOCUMENTS

| | | | |
|---|---|---|---|
| 4,909,843 | 3/1990 | Leithner | 75/237 |
| 5,108,493 | 4/1992 | Causton | 75/255 |
| 5,154,881 | 10/1992 | Rutz et al. | 419/37 |
| 5,368,630 | 11/1994 | Luk | 75/252 |
| 5,403,371 | 4/1995 | Engdahl et al. | 75/230 |
| 5,462,573 | 10/1995 | Baker et al. | 75/231 |

*Primary Examiner*—Ngoclan Mai

*Attorney, Agent, or Firm*—Eugene J. A. Gierczak

[57] ABSTRACT

This invention relates to a process of forming a sintered article of powder metal comprising blending graphite and lubricant with a pre-alloyed iron based powder, pressing said blended mixture to shape in a single compaction stage sintering said article, and then high temperature sintering said article in a reducing atmosphere to produce a sintered article having a density greater than 7.4 g/cc.

6 Claims, 8 Drawing Sheets

MODULUS VERSUS DENSITY

Controlling Technologies: High Density processing

High Density Powder Metal Process Stages - Schematic Diagram

High Density Powder Metal Process Stages - Schematic Diagram

The eutectoid portion of the Fe-$Fe_3C$ phase diagram.

HI-DENSITY SINTERED ALLOY AND SPHEROIDIZATION METHOD FOR PRE-ALLOYED POWDERS

This is a division of application Ser. No. 08/496,726, filed Jun. 29, 1995, U.S. Pat. No. 5,552,109.

FIELD OF INVENTION

This invention relates to a method or process of forming a sintered article of powder metal having a high density and in particular relates to a process of forming a sintered article from powdered metal by use of a pre-alloyed powder as the base material and adding graphite and other additives thereto and then high temperature sintering of the article in a reducing atmosphere to produce sintered parts having a high density, followed by spheroidizing. In particular, this invention relates to a process of forming a sintered article of powder metal having a high density by blending graphite with a pre-alloyed iron based powder containing molybdenum followed by heat treatment to spheroidize the carbides in the microstructure to produce an article with combined high strength and toughness.

BACKGROUND TO THE INVENTION

Powder metal technology is well known to the persons skilled in the art and generally comprises the formation of metal powders which are compacted and then subjected to an elevated temperature so as to produce a sintered product.

Moreover, U.S. Pat. No. 2,289,569 relates generally to powder metallurgy and more particularly to a low melting point alloy powder and to the usage of the low melting point alloy powders in the formation of sintered articles.

The modulus of elasticity and toughness of conventional powder metal articles is limited by density. Conventional powder metal processes are limited to approximately 7.2 g/cc by single press, single sinter techniques. At added cost double press, double sintering can be used to increase density.

Furthermore various processes have heretofore been designed in order to produce sintered articles having high densities. Such processes include a double press double sintering process for densities typically up to 7.5 g/cc as well as hot powder forging where virtually full densities of up to 7.8 g/cc may be obtained. However, such prior art processes are relatively expensive and time consuming. Recently developed methods include warm pressing of powders to up to 7.35 g/cc as disclosed in U.S. Pat. No. 5,154,881 (Rutz). However there are process disadvantages with the warm pressing such as maintaining tool clearances with heated systems. Also warm pressing does not allow very high densities up to and above 7.5 g/cc to be easily reached in commonly used alloy systems without double pressing and double sintering.

Yet another process is disclosed in U.S. Pat. No. 2,027,763 which relates to a process of making sintered hard metal and consists essentially of steps connected with the process in the production of hard metal. In particular, U.S. Pat. No. 2,027,763 relates to a process of making sintered hard metal which comprises producing a spray of dry, finely powdered mixture of fusible metals and a readily fusible auxiliary metal under high pressure producing a spray of adhesive agent customary for binding hard metals under high stress, and so directing the sprays that the spray of metallic powder and the spray of adhesive liquid will meet on their way to the molds, or within the latter, whereby the mold will become filled with a compact moist mass of metallic powder and finally completing the hard metallic particle thus formed by sintering.

U.S. Pat. No. 4,707,332 teaches a process for manufacturing structural parts from intermetallic phases capable of sintering by means of special additives which serve at the same time as sintering assists and increase the ductility of the finished structural product.

Moreover, U.S. Pat. No. 4,464,206 relates to a wrought powder metal process for pre-alloyed powder. In particular, U.S. Pat. No. 4,464,206 teaches a process comprising the steps of communinuting substantially non-compactable pre-alloyed metal powders so as to flatten the particles thereof heating the communinuted particles of metal powder at an elevated temperature, with the particles adhering and forming a mass during heating, crushing the mass of metal powder, compacting the crushed mass of metal powder, sintering the metal powder and hot working the metal powder into a wrought product.

Other methods to densify or increase the wear resistance of sintered iron based alloys are disclosed in U.S. Pat. No. 5,151,247 which relates to a method of densifying powder metallurgical parts while U.S. Pat. No. 4,885,133 relates to a process for producing wear-resistant sintered parts.

The processes as described in the prior art all have serious shortcomings in cost effectively producing the desired mechanical properties of the sintered product.

It is a further object of this invention to provide a process for producing sintered articles of densities greater than 7.4 g/cc by a single compaction, single sinter process.

It is an object of this invention to provide an improved process for producing sintered articles having improved dynamic strength characteristics and an accurate method to control same.

It is a further object of this invention to provide an improved process for producing sintered articles having improved strength characteristics with carbon contents above 0.8% and in particular between 0.8% to 2.0% carbon and an accurate method to control same.

It is a further aspect of this invention to produce PM articles with high ductility by spheroidization.

Historically steels have been produced with carbon contents of less than 0.8%. However ultrahigh carbon steels have been produced. Ultrahigh carbon steels are carbon steels containing between 0.8% to 2.0% carbon. The processes to produce ultra high carbon steels with fine spheroidized carbides are disclosed in U.S. Pat. No. 3,951,697 as well as in the article by D. R. Lesver, C. K. Syn, A. Goldberg, J. Wadsworth and O. D. Sherby, entitled "The Case for Ultrahigh-Carbon Steels as Structural Materials" appearing in Journal of the Minerals, Metals and Materials Soc., August 1993.

Applicant has filed PCT application No. PCT/CA94/00065 on Feb. 7, 1994 as well as U.S. application 08/193,578 on Feb. 8, 1994 for an invention entitled HI-DENSITY SINTERED ALLOY concerning the process of forming sintered articles of powder metal by blending combinations of finely ground ferro alloys with iron powders to produce sintered parts in a reducing atmosphere to produce sintered parts having a high density.

It is an object of this invention to provide another improvement in producing high density sintered parts by use of pre-alloyed powder as the base material and adding graphite thereto.

The broadest aspect of this invention relates to a process of forming a sintered article of powder metal comprising blending graphite and lubricant with a pre-alloyed iron based powder pressing said blended mixture to shape in a single compaction stage sintering said article, and then high temperature sintering said article in a reducing atmosphere to produce a sintered article having a density greater than 7.4 g/cc.

It is another aspect of this invention to provide a process of forming a sintered article of powder metal comprising blending graphite of approximately 0.8% to 2.0% by weight and lubricant with a pre-alloyed iron based powder containing about 0.5% to 3.0% molybdenum, pressing said blended mixture to shape in a single compaction stage, sintering said article, and then high temperature sintering said article in a reducing atmosphere to produce a sintered article having a higher density.

It is another aspect of this invention to provide a powder metal composition comprising a blend of pre-alloyed iron based powder and graphite so as to result in an as sintered mass having between: 0.5% to 3.0% molybdenum; 0.8% to 2.0% graphite; remainder being iron and unavoidable impurities.

DESCRIPTION OF DRAWINGS

These and other features and objections of the invention will now be described in relation to the following drawings.

DESCRIPTION OF THE INVENTION

Sintered Powder Metal Method

The invention disclosed herein utilizes high temperature sintering of 1250° C. to 1,350° C. and a reducing atmosphere of, for example hydrogen, hydrogen/nitrogen, or in vacuum. Moreover, the reducing atmosphere in combination with the high sintering temperature reduces or cleans off the surface oxides allowing the particles to form good bonds and the compacted article to develop the appropriate strength.

The lubricant is added in a manner well known to those persons skilled in the art so as to assist in the binding of the powder as well as assisting in the ejecting of the product after pressing. An example of lubricant which can be used is Zn stearate. The article is formed by pressing the mixture into shape by utilizing the appropriate pressure of, for example, 25 to 50 tonnes per square inch.

Heat treating stages may be introduced after the sintering stage. Secondary operations such as coining, resizing, machining or the like may be introduced after the sintering stage.

Furthermore, the microstructure of the finished product are improved as they exhibit:

(a) high density;

(b) well rounded pores;

(c) a homogenous structure;

(d) finely dispersed spheroidized carbides; and (e) a product that is more similar to wrought steels in properties than conventional powder metal steels.

Ultrahigh Carbon Steel

Typically the percentage of carbon steel lies in the range of up to 0.8% carbon. Ultrahigh carbon steels are carbon steels containing between 0.8% to 2% carbon.

Figure 1:
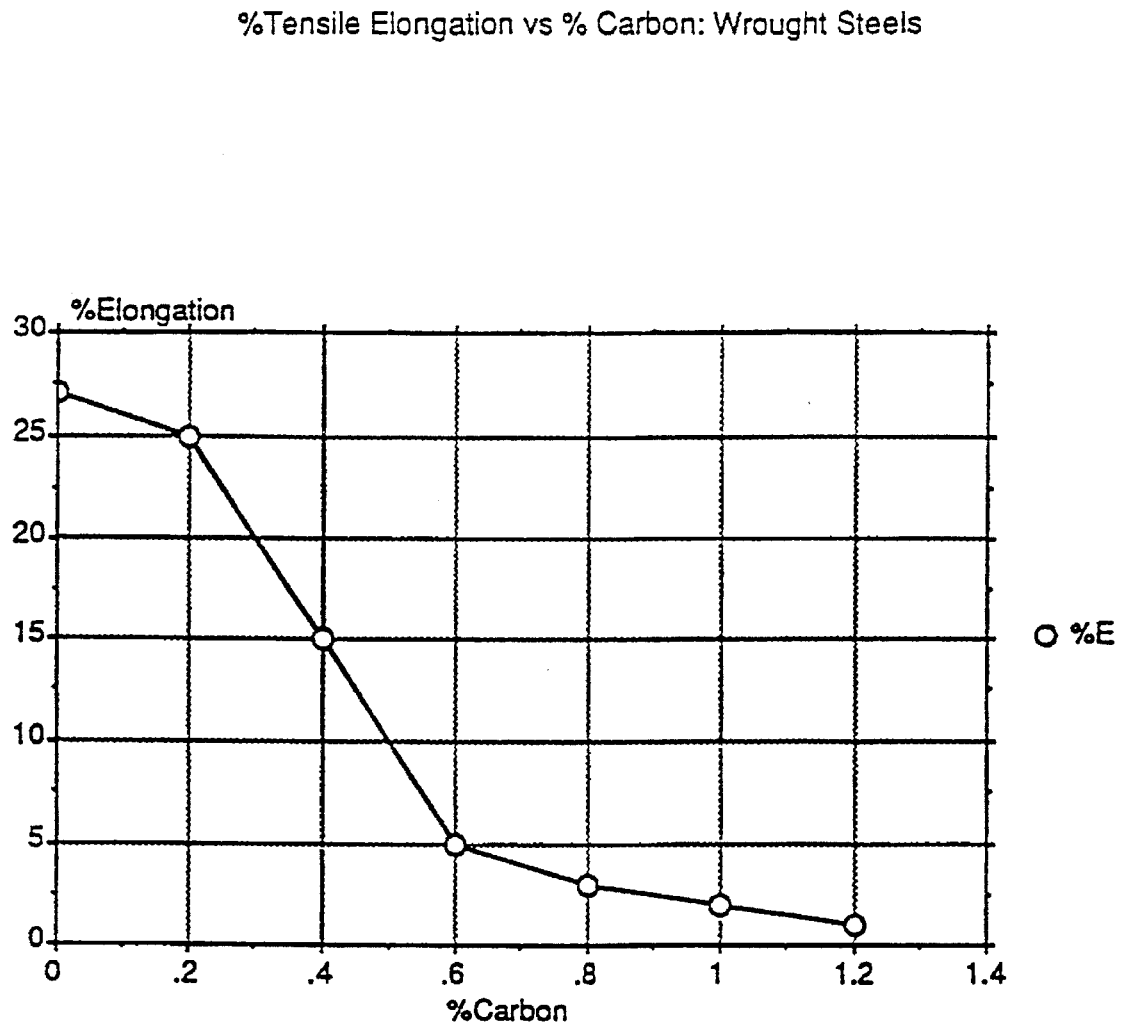
FIG. 1 is an elongation to percent carbon graph.

It is known that tensile ductility decreases dramatically with an increase in carbon content and accordingly ultrahigh carbon steels have historically been considered too brittle to be widely utilized. FIG. 1 shows the relationship between elongation or ductility versus the carbon content of steels. It is apparent from FIG. 1 that the higher the percentage of carbon, the less ductile the steel. Moreover, by reducing the carbon in steels, this also reduces its tensile strength.

However, by using the appropriate heat treatments for ultrahigh carbon steels, high ductilities as well as high strengths may be obtained.

Ultrahigh Carbon Steel Powder Metals with Hi-Density Sintered Alloys

Figure 6:
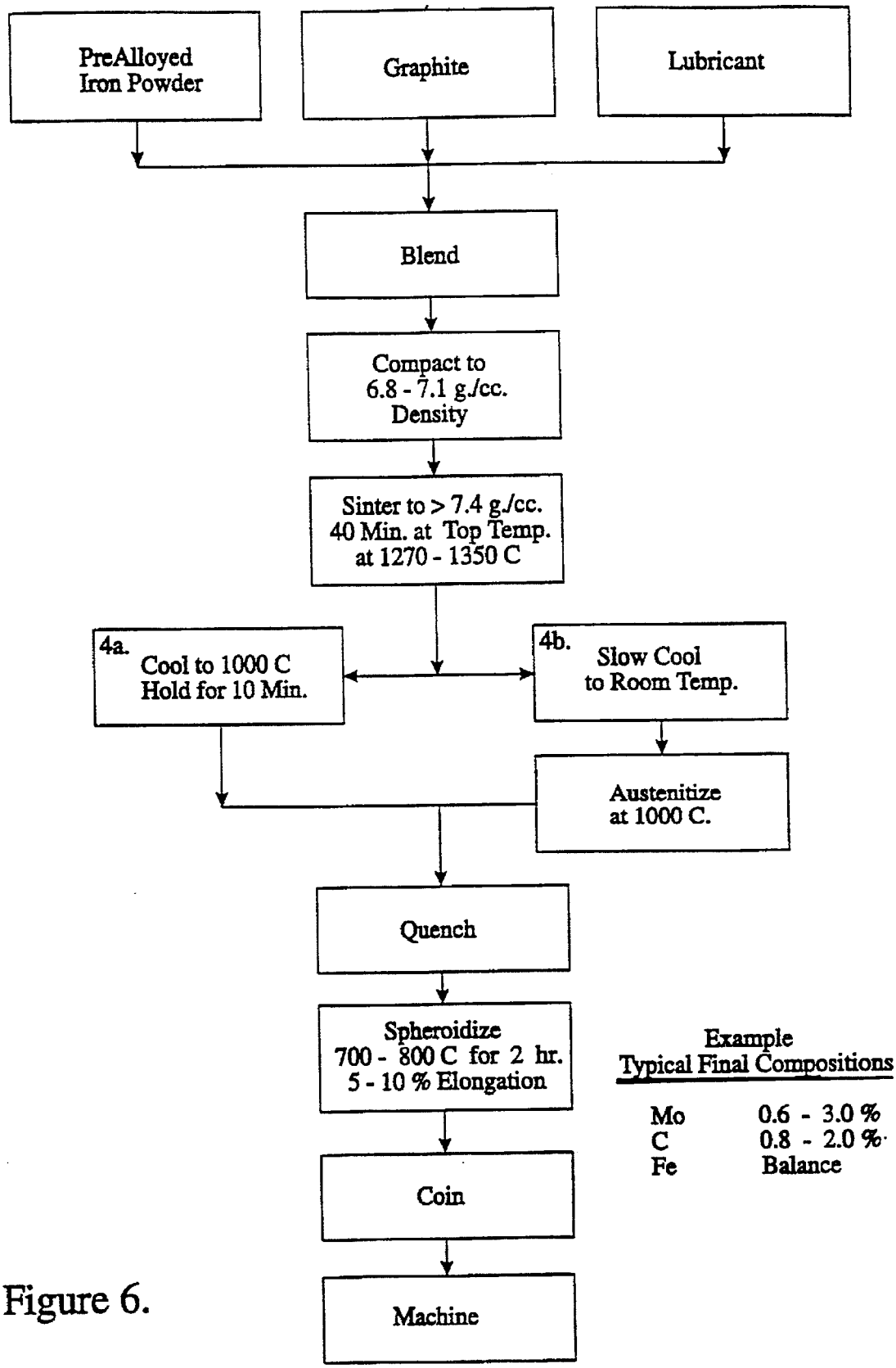
FIG. 6 is a flow chart.

The invention described herein comprises blending graphite and lubricant with a pre-alloyed iron based powder as described herein and illustrated in FIG. 6. An example of the graphite utilized herein consists of 3203 grade from Asbury but can include other grades of graphite.

Pre-alloyed powder as used herein consists of a metallic powder composed of two or more elements which are alloyed in the powder manufacturing process, and in which the particles are of the same nominal composition throughout.

The method described herein may be adapted to produce a high density grade powder metal sintered product having an ultrahigh carbon content with the following composition:

| | |
|---|---|
| Mo | 0.5–3.0% |
| C in the form of graphite | 0.8 to 2.0% |
| Fe and other unavoidable impurities | the remainder |

The graphite is blended with the lubricant and the pre-alloyed iron based powder containing molybdenum and is then compacted by conventional pressing methods to a minimum of 6.8 g/cc. Sintering then occurs in a vacuum, or in a vacuum under partial Backfill (i.e. bleed in argon or nitrogen), or pure hydrogen, or a mixture of $H_2/N_2$ at a temperature of 1250° C. to 1350° C. and in particular 1270° C. to 1310° C. The vacuum typically occurs at approximately 200 microns. Moreover, the single step compaction typically occurs preferably between 6.8 g/cc to 7.1 g/cc.

It has been found that by utilizing the composition referred to above, hi-density as sintered articles greater than 7.4 g/cc can be produced in a single compression single sinter stage rather than by a double pressing, double sintering process. By utilizing the invention disclosed herein hi-density sintered articles can be produced having a sintered density of 7.4 g/cc to 7.7 g/cc.

Such hi-density sintered articles may be used for articles requiring the following characteristics, namely:

high modulus (stiffness)

high wear resistance high tensile properties high fatigue strength high toughness (high impact strength)

good machinability

Figure 2:
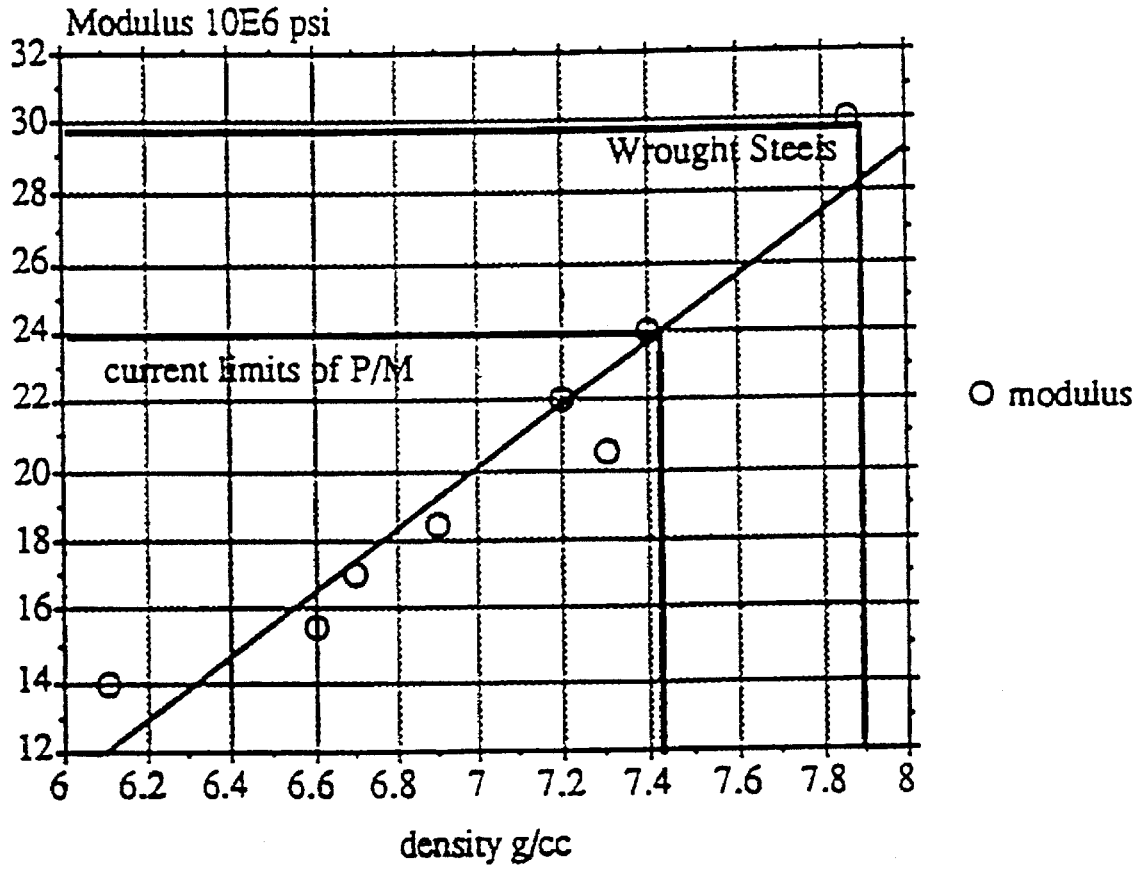
FIG. 2 is a modulus to density graph.

FIG. 2 shows the relationship between the density of a sintered article and the modulus. It is apparent from FIG. 2 that the higher the density the higher the modulus.

It should be noted that tensile strengths of approximately 100–120 ksi as well as impact strengths of approximately 50 foot pounds have been achieved by using the high density sintered alloy method described herein.

By adding the graphite to the pre-alloyed powder and sintering same in a vacuum or vacuum with backfill, or pure hydrogen or $N_2H_2$, at a temperature of 1270° C. to 1350° C., a high density sintered alloy can be produced via supersolidus sintering. With respect to the composition referred to above, an alloy having a sintered density of 7.6 g/cc may be produced by single stage compaction and sintering at 1280° C. to 1310° C. under vacuum, or in a reducing atmosphere containing $H_2/N_2$.

Particularly good results have been achieved by utilizing a pre-alloyed iron based powder of iron with 0.85% molybdenum in the pre-alloyed form blended with a 1.5% graphite addition and a lubricant. More particularly a suitable commercial grade which is available in the market place is sold under the designation of QMP AT 4401 which has the following quoted physical and chemical properties:

| | |
|---|---|
| Apparent density | 2.92 g/cm$^3$ |
| Flow | 26 seconds/50 g. |
| Chemical Analysis | |
| C | 0.003% |
| O | 0.08% |
| S | 0.007% |
| P | 0.01% |
| Mn | 0.15% |
| Mo | 0.85% |
| Ni | 0.07% |
| Si | 0.003% |
| Cr | 0.05% |
| Cu | 0.02% |
| Fe | greater than 98% |

The commercially available pre-alloy referred to above consists of 0.85% molybdenum pre-alloyed with iron and unavoidable impurities. The existence of unavoidable impurities is well known to those persons skilled in the art.

Other grades of pre-alloyed powder may be employed. Graphitisation elements such as Ni and Si (other than as trace elements) are to be avoided.

Heat Treatment - Spheroidization

Figure 3:
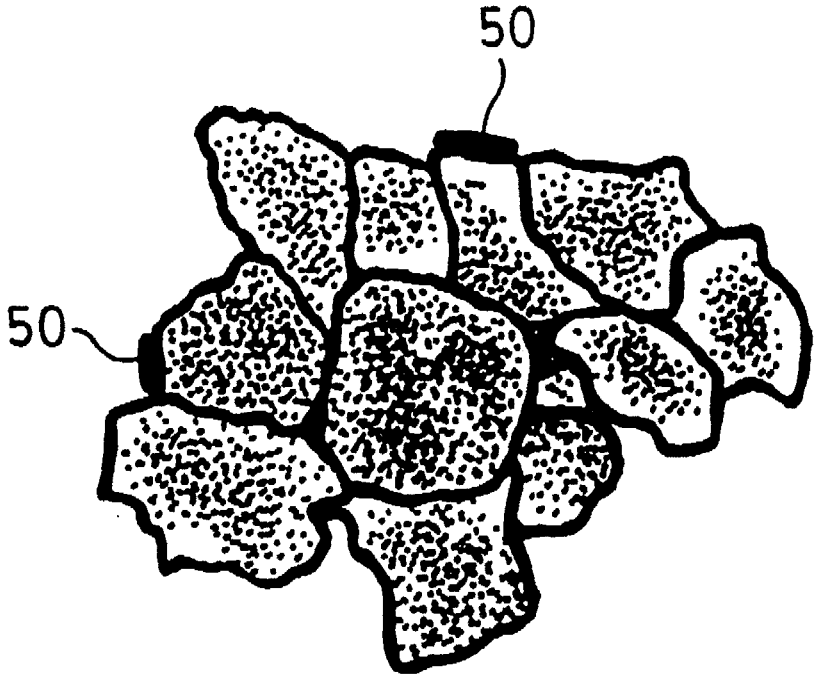
FIG. 3 is a sketch of grain boundary carbides in an as sintered article.
Figure 7:
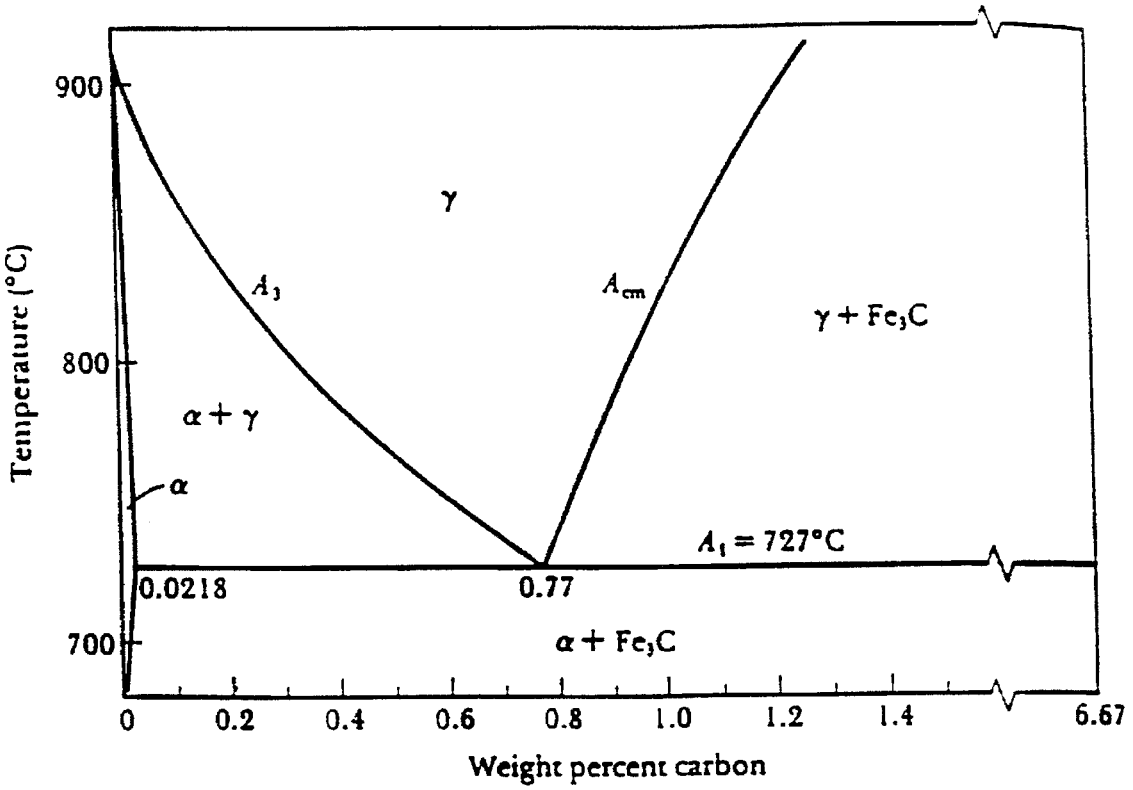
FIG. 7 illustrates the eutectoid portion of the Fe-$Fe_3C$ phase diagram.

The sintered ultrahigh carbon steel article produced in accordance with the method described herein exhibits a hi-density although the article will tend to be brittle for the reasons described above. In particular, the brittleness occurs due to the grain boundary carbides 50, which are formed as shown in FIG. 3. The grain boundary carbides 50 will precipitate during the austenite to ferrite transformation during cooling. It should be noted that iron has a ferrite and austenite phase. Moreover, up to 0.02% carbon can be dissolved in ferrite or (alpha) phase, and up to 2.0% in the austenite or (gamma) phase. The transition temperature between the ferrite and austenite phase is approximately 727° C. as illustrated in FIG. 7. Spheroidizing is any process of heating and cooling steel that produces a rounded or globular form of carbide.

Spheroidization is the process of heat treatment that changes embrittling grain boundary carbides and other angular carbides into a rounded or globular form. In prior art, the spheroidization process is time consuming and uneconomical as the carbides transform to a rounded form only very slowly. Typically, full spheroidization required long soak times at temperature. One method to speed the process is to use thermomechanical treatments, which combines mechanical working and heat to cause more rapid spheroidization. This process is not suited to high precision, net shape parts and also has cost disadvantages.

Figure 4A:
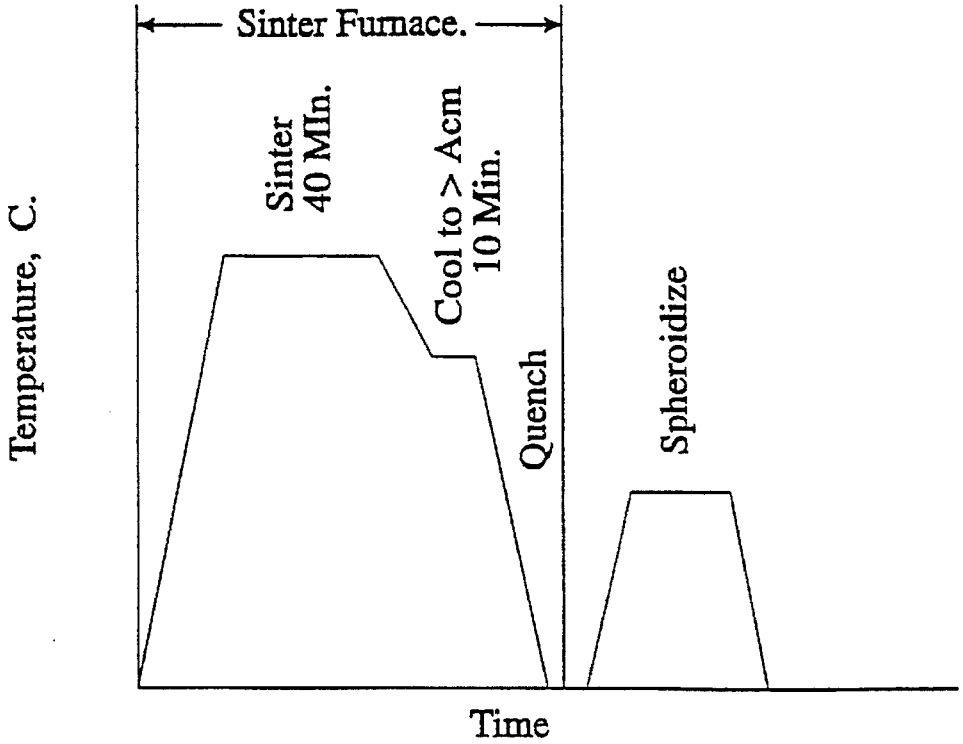
FIG. 4*a* is a schematic diagram of the high density powder metal process stages.

A method for spheroidization has been developed for high density sintered components whereby the parts are sintered, cooled within the sinter furnace to above the $A_{CM}$ of approximately 1000° C. and rapidly quenched to below 200° C., so that the precipitation of embrittling grain boundary carbides is prevented or minimised. This process results in the formation of a metastable microstructure consisting largely of retained austenite and martensite. A subsequent heat treatment whereby the part is raised to a temperature near the $A_1$ temperature (700° C. to 800° C.) results in relatively rapid spheroidization of carbides, and combined high strength and ductility. FIG. 4*a* is a graph which illustrates this method for spheroidization. The process of FIG. 4*a* is also illustrated in FIG. 6. The quenching which is illustrated graphically in FIG. 4*a* may occur by oil quenching.

Figure 4B:
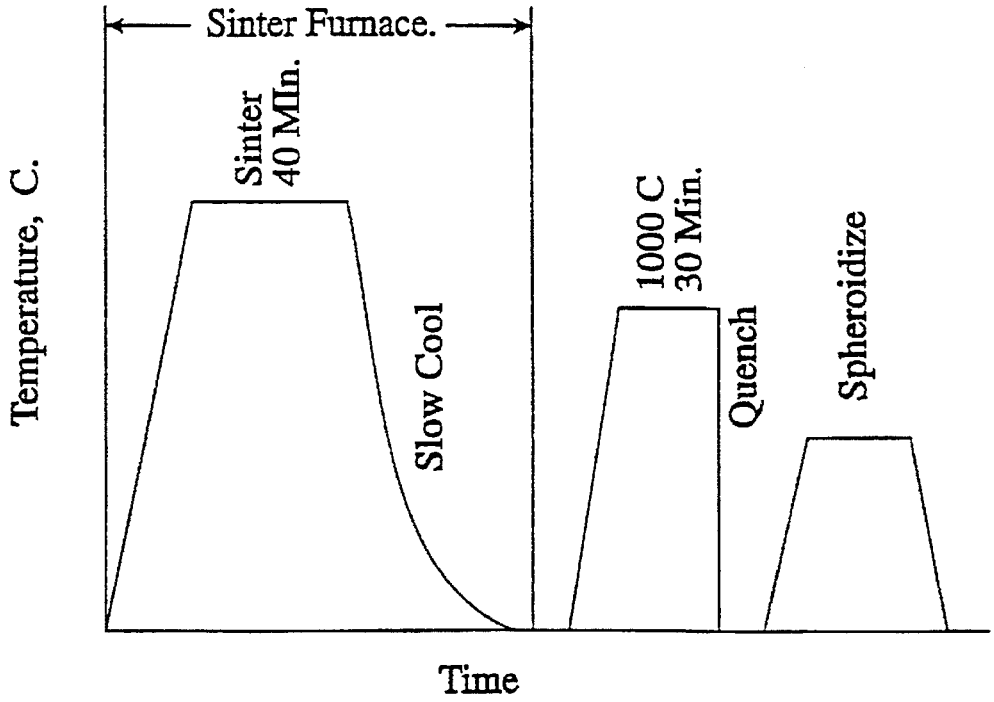
FIG. 4*b* is a schematic diagram of another embodiment of the high density powder metal process stages.

In another embodiment, parts are sintered as described above, in the first stage, but allowed to cool to room temperature as shown in FIG. 4*b*. The sintered microstructure will therefore contain the embrittling carbides. The second stage is carried out on a separate heat treatment line, whereby parts are austentised at approximately 1000° C. to dissolve the carbides, and oil quenched, followed by spheroidization.

Accordingly, by spheroidizing the as sintered ultrahigh carbon steel, such process gives rise to a powder metal having high ductility, typically 5–10% tensile elongation and high strength of 100–120 ksi UTS. The spheroidizing treatment causes the carbides to assume a spherical, less brittle form.

The powder metal ultrahigh carbon steel that has been spheroidized, gives rise to a hi-density P/M steel having a good balance of properties with high strength and ductility.

This ductility enables parts to be coined to maintain good dimensional accuracy. Such sintered parts may be used in the spheroidizod condition or further heat treated for very high strength components.

Moreover, the ultrahigh carbon steel powder metal may also be conventionally heat treated after spheroidization, partially dissolving the spheroidized carbides, for very high strength and durability, such as:

1. austenitize matrix;
2. quench to martensite;
3. temper martensite

Connecting Rods

Various sintered articles can be made in accordance with the invention described herein. One particularly good application of the invention described herein relates to the manufacture of automobile engine connecting rods or con rods.

Although the sintered connecting rods have heretofore been manufactured in the prior art as particularized in the article entitled "Fatigue Design of Sintered Connecting Rods" appearing in Journal of the Minerals, Metals and Materials Soc., May 1988.

Figure 5:
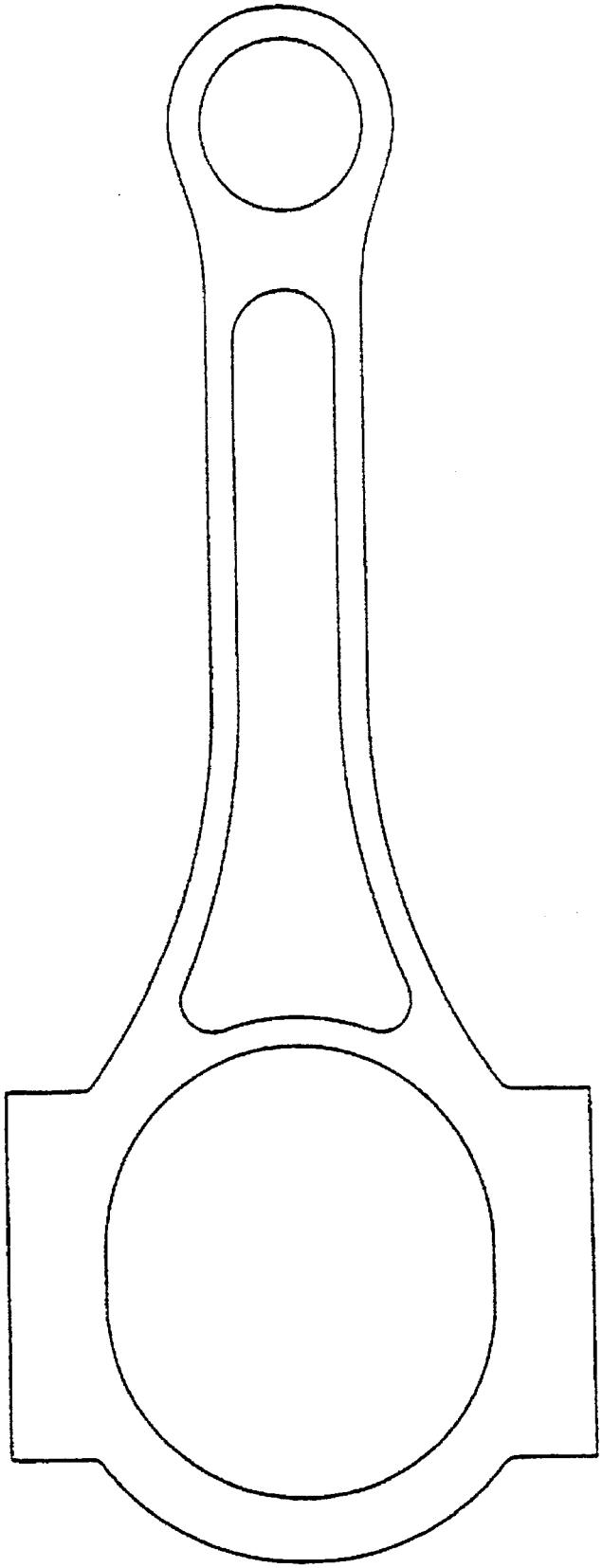
FIG. 5 is a top plan view of a connecting rod made in accordance with the invention described herein.

However, such prior art single press, single sintered connecting rods have not been produced on a commercial basis as these single press, single sinter rods do not have high density and modulus of elasticity. Moreover, some designs require heat treatment for high strength and are difficult to machine. FIG. 5 illustrates a connecting rod.

In particular, hi-density sintered alloy connecting rods can be produced in accordance with the hi-density sintered alloy method described herein, as well as the ultra-high carbon steel as described herein.

More particularly, automobile connecting rods can be manufactured having the following compositions:

| | |
|---|---|
| Mo | 0.6% to 3.0% |
| C | 0.8% to 2.0% |
| Fe | balance |
| plus unavoidable impurities | |

Such automobile connecting rods have exhibited the following characteristics, namely:

| As Spheroidized: | |
|---|---|
| UTS (ultimate tensile stress) | 120 ksi |
| YS (yield) | 95 ksi |
| % Elongation | 8% |
| Impact Strength | 40 ft/lbs. |
| Reverse Bending Fatigue | 40 ksi |

References to percentages herein refer to percent by weight.

In the as-spheroidized condition, components may show a certain degree of distortion. For example a sintered con-rod may have a side elevational taper from top (narrower) to bottom (wider) and variable shrinkage from part to part. Spheroidization as described herein results in sintered parts having high ductility thereby permitting the part to be precision cold coined, achieving good dimensional accuracy.

Figure 8:
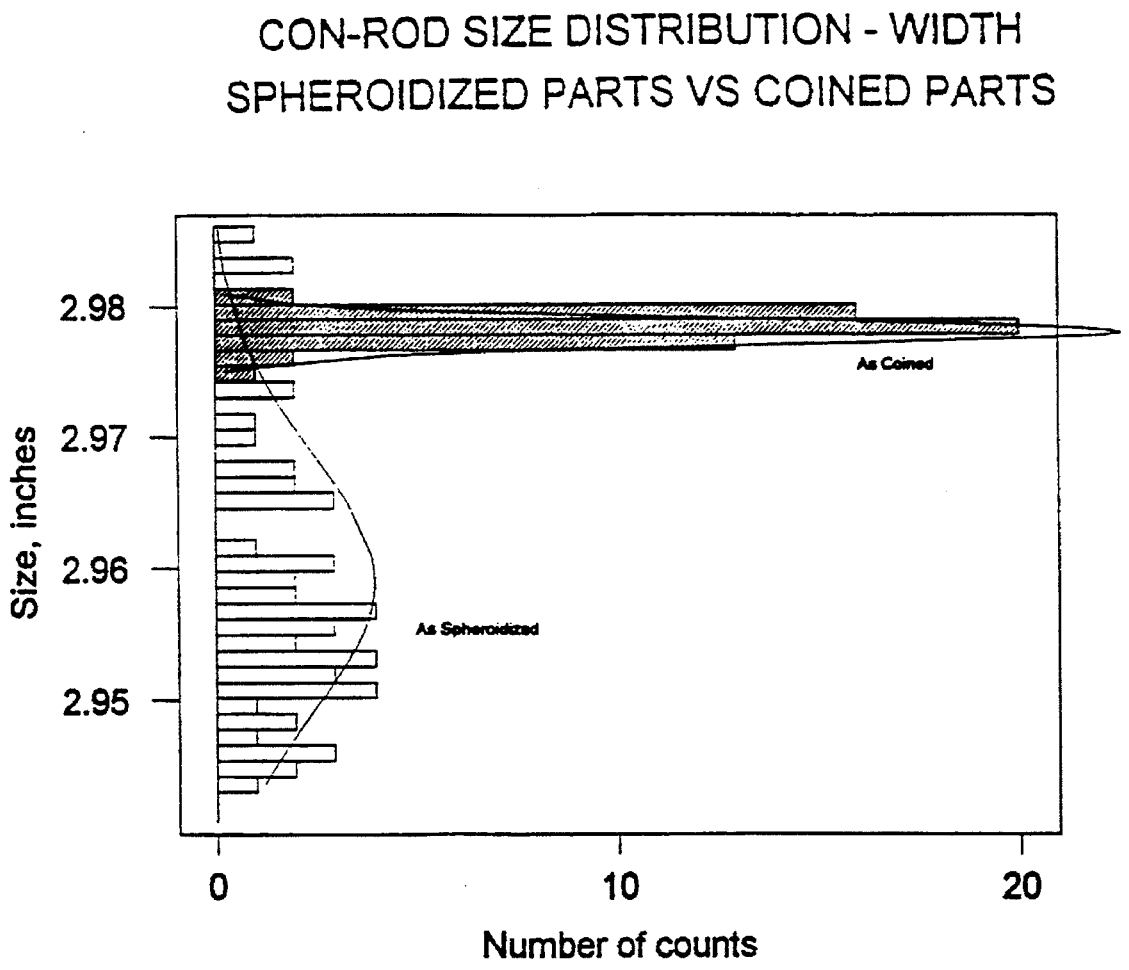
FIG. 8 is a con-rod size distribution graph.

For example FIG. 8 illustrates variations in dimension X of FIG. 5 in the as spheriodized condition using the QMP AT 4401 composition referred to earlier with 1.5% graphite, as well as the variation after coining. In particular, FIG. 8 shows an approximate variation in the as spheriodized condition of approximately 2.94 to 2.99 inches while the coined variation is approximately 2.975 to 2.98 inches.

Other products such as highly stressed transmission gears can also be made in accordance with the invention described herein.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A sintered powder metal article made by sintering a mixture of pre-alloyed iron based powder and graphite, comprising:

(a) a pre-alloyed iron based powder of iron having between 0.5% to 3.0% by weight molybdenum;

(b) 0.8% to 2.0% carbon by weight;

(c) a lubricant;

(d) unavoidable impurities and having a density greater than 7.4 g/cc.

2. A sintered powder metal article as claimed in claim 1 wherein said lubricant comprises zinc stearate.

3. A sintered powder metal article as claimed in claim 1 wherein said pre-alloyed iron based powder consist essentially of 0.85% molybdenum.

4. A sintered powder metal article as claimed in claim 3 wherein said carbon consist essentially of 1.5%.

5. A connecting rod made by sintering a mixture of pre-alloyed iron based powder and graphite, consisting essentially of:

(a) a pre-alloyed iron based powder of iron having between 0.6% to 3.0% by weight molybdenum;

(b) 0.8% to 2.0% by weight carbon;

(c) unavoidable impurities and a density greater than 7.4 g/cc.

6. A connecting rod as claimed in claim 5 having an ultimate tensile stress of approximately 120 ksi.

* * * * *